US008959795B2

(12) United States Patent
Cristea

(10) Patent No.: US 8,959,795 B2
(45) Date of Patent: Feb. 24, 2015

(54) FLIP FLOP AND SLIPPER IN ONE/CONVERTIBLE SANDAL SLIPPER

(76) Inventor: Robert Oscar Cristea, Andover, NJ (US)

( * ) Notice: Subject to any disclaimer, the term of this patent is extended or adjusted under 35 U.S.C. 154(b) by 458 days.

(21) Appl. No.: 13/323,044

(22) Filed: Dec. 12, 2011

(65) Prior Publication Data

US 2012/0079739 A1 Apr. 5, 2012

Related U.S. Application Data

(63) Continuation-in-part of application No. 13/219,828, filed on Aug. 29, 2011, now abandoned.

(60) Provisional application No. 61/385,055, filed on Sep. 21, 2010.

(51) Int. Cl.

| | |
|---|---|
| ***A43B 3/12*** | (2006.01) |
| ***A43B 3/24*** | (2006.01) |
| ***A43B 3/10*** | (2006.01) |

(52) U.S. Cl.

CPC . *A43B 3/242* (2013.01); *A43B 3/24* (2013.01); *A43B 3/122* (2013.01); *A43B 3/102* (2013.01); *A43B 3/103* (2013.01); *A43B 3/105* (2013.01)

USPC ..... 36/11.5; 36/100

(58) Field of Classification Search

CPC ..... A43B 3/24; A43B 3/242; A43B 23/24; A43B 3/0078; A43B 3/246; A43B 3/122; A43B 13/36

USPC ..... 36/100, 101, 103, 11.5

See application file for complete search history.

(56) References Cited

U.S. PATENT DOCUMENTS

| | | | | |
|---|---|---|---|---|
| 1,090,731 | A * | 3/1914 | Lindberg | 36/11.5 |
| 5,737,853 | A | 4/1998 | Smejkal | |
| 6,594,918 | B2 | 7/2003 | Hatfield et al. | |
| 7,010,872 | B2 * | 3/2006 | Pawlus et al. | 36/100 |
| 7,134,225 | B2 * | 11/2006 | Ashton | 36/94 |
| 7,222,442 | B2 * | 5/2007 | Hillyer et al. | 36/11.5 |
| 7,331,122 | B2 | 2/2008 | Januszewski et al. | |
| 7,347,012 | B2 * | 3/2008 | Clark et al. | 36/50.1 |
| 7,631,440 | B2 * | 12/2009 | Keen et al. | 36/50.1 |
| 8,677,653 | B2 * | 3/2014 | Avar et al. | 36/50.1 |
| 2004/0255486 | A1 * | 12/2004 | Pawlus et al. | 36/10 |
| 2006/0064902 | A1 * | 3/2006 | Ashton | 36/72 R |

* cited by examiner

*Primary Examiner* — Jila M Mohandesi
(74) *Attorney, Agent, or Firm* — Baker Botts, L.L.P.

(57) ABSTRACT

A combination apparatus for footwear including a first apparatus into which an individual's foot can be inserted, and a second apparatus into which the individual's foot can be inserted. The second apparatus is adapted to be inserted into the first apparatus. The first apparatus includes a first attachment device, and the second apparatus includes a second attachment device. In at least one embodiment the second apparatus and the first apparatus can be attached, while the second apparatus is inserted into the first apparatus by attaching the first attachment device to the second attachment device. The first apparatus may be a flip-flop or a sandal and the second apparatus may be a slipper and may be made of water proof material.

10 Claims, 7 Drawing Sheets

FLIP FLOP AND SLIPPER IN ONE/CONVERTIBLE SANDAL SLIPPER

CROSS REFERENCE TO RELATED APPLICATION(S)

This application is a continuation in part of and claims the priority of U.S. patent application Ser. No. 13/219,828, filed on Aug. 29, 2011, titled "Flip Flop and Slipper in One/Convertible Sandal Slipper", now abandoned, which claims the priority of U.S. Provisional Patent application Ser. No. 61/385,055, filed on Sep. 21, 2010; and this application claims the priority of both Ser. Nos. 13/219,828 and 61/385,055.

FIELD OF THE INVENTION

The present invention relates to footwear.

BACKGROUND OF THE INVENTION

There are various devices known in the prior art for footwear.

SUMMARY OF THE INVENTION

Flip-flops are one of the most popular shoes, they are easy to put on, light, covering only a tiny part of feet. Many women wear flip-flops, often choosing comfort over fashion and others prefer to suffer and be in style. Even young women wear flip-flops during the winter for casual or clubbing events instead of wearing high-heeled shoes. People may still be wearing flip-flops even after the temperatures have dropped. How do they keep comfortable and keep their feet warm while wearing them?

One or more embodiments of the present invention provide an answer to this problem by creating flip-flops and slippers as one (a convertible sandal slipper). In at least one embodiment, stretchy fabric is attached to the flip-flop's foot bed. An individual can use them as flip-flops by placing the feet on top of the foot bed lining. When the individual's feet become cold, he or she can place his or her feet under the fabric and use the combination flip-flops/slippers as slippers. The fabric will keep the individual's feet warm. These, "Slip-Flops" can be used from early spring to summer to late fall. Individuals can use them as flip-flops as they go out and use them as slippers as the evening gets cold. "Slip-Flops" are a perfect solution where an individual can place feet under the fabric and use them as slippers. The fabric will keep the individual's feet warm.

In at least one embodiment of the present invention an apparatus or combination apparatus is provided comprising a first apparatus into which an individual's foot can be inserted, and a second apparatus into which the individual's foot can be inserted. The second apparatus is adapted to be inserted into the first apparatus. The first apparatus includes a first attachment device, and the second apparatus includes a second attachment device. In at least one embodiment the second apparatus and the first apparatus can be attached, while the second apparatus is inserted into the first apparatus by attaching the first attachment device to the second attachment device. In at least one embodiment, the first attachment device and the second attachment device can be detached to detach the first apparatus from the second apparatus. The first apparatus may be a flip-flop or a sandal and the second apparatus may be a slipper. The second apparatus may be a water proof material.

In at least one embodiment a method is provided which includes inserting an individual's foot into a first apparatus; inserting the first apparatus, while the individual's foot is inserted in the first apparatus, into a second apparatus; attaching the first apparatus to the second apparatus by attaching a first attachment device of the first apparatus to a second attachment device of the second apparatus; and walking with the first apparatus attached to the second apparatus and with the individual's foot inserted into the first apparatus, so that the individual's foot moves the first apparatus and the second apparatus while walking.

DETAILED DESCRIPTION OF THE DRAWINGS

This present application hereby incorporates by reference U.S. patent application Ser. No. 13/219,828, filed on Aug. 29, 2011, titled "Flip Flop and Slipper in One/Convertible Sandal Slipper" and U.S. Provisional Patent application No. Ser. No. 61/385,055, filed on Sep. 21, 2010 in their entirety.

Figure 1A:
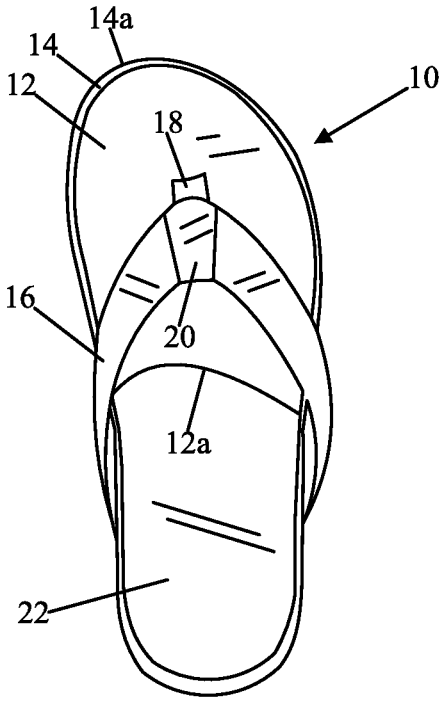
FIG. 1A shows a top view of an apparatus in accordance with an embodiment of the present invention.
Figure 1B:
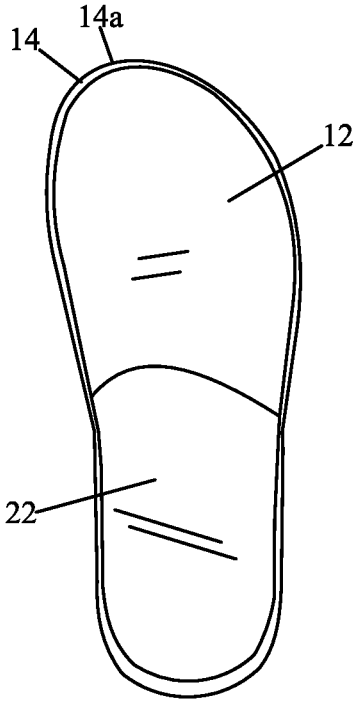
FIG. 1B shows a top view of a covering of the apparatus of FIG. 1A.

FIG. 1A shows a top view of an apparatus 10 which in one or more embodiments may be characterized as a combination flip flop and slipper. The apparatus 10 includes a base 14, a covering 12, a strap 16, and portions 18 and 20, and a surface 22. FIG. 1B shows a top view of the covering 12 and the base 14 without the strap 16 and without the portions 18 and 20.

Figure 1C:
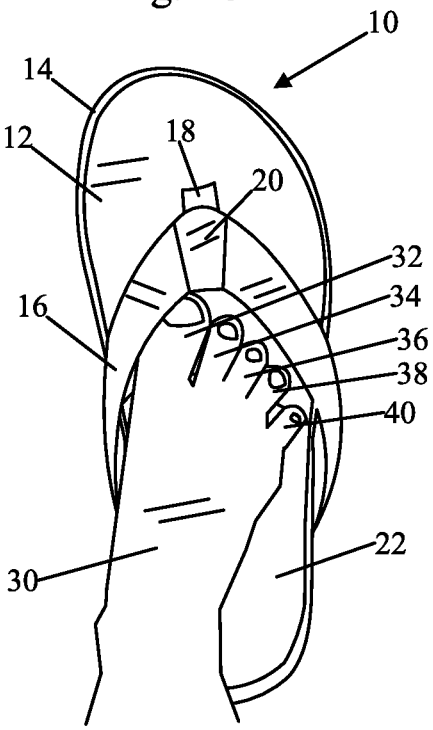
FIG. 1C shows a top view of a foot of an individual placed on top of the apparatus of FIG. 1A so that the foot rests on top of the covering of FIG. 1B.
Figure 1D:
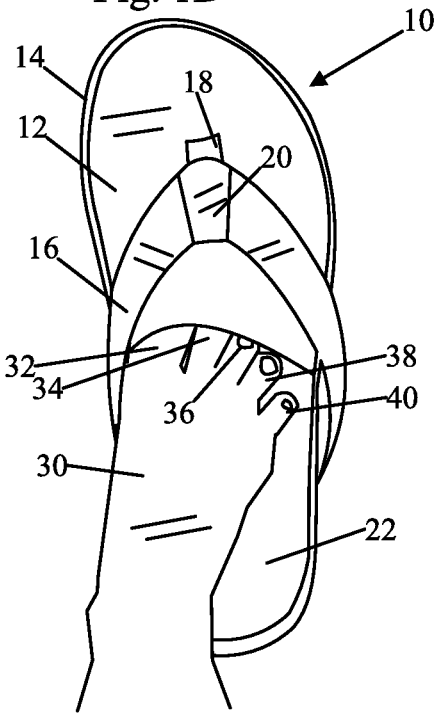
FIG. 1D shows a top view of the foot of the individual at least partially inserted underneath the covering of FIG. 1B.

FIG. 1C shows a top view of a foot 30 of an individual placed on top of the apparatus 10 so that the foot 30 rests on top of the covering 12 and not underneath the covering 12. FIG. 1D shows a top view of the foot 30 of an individual with toes 32, 34, and 36, at least partially inserted underneath the covering 12, so they are between the covering 12 and the base 14.

The covering 12 may be a stretchy fabric which is securely attached to the perimeter edge 14*a* of the base 14 or flip-flop foot bed. This can be achieved by fusion, sawing or sandwiching between the inner and outer sole of the base 14 or flip-flop foot bed. One can use the apparatus 10, also called a "Slip Flop" as a regular flip-flop by simply placing your feet in the apparatus 10, under the strap 16 and on top of the covering or fabric 12 as shown partially in FIG. 1C. In use, the foot 30 would be inserted further under the strap 16 in order to wear the apparatus 10 on the foot 30.

However, the covering 12, which may be a stretchy fabric, allows a person to slip their foot 30 under the covering 12 as shown partially in FIG. 1D and under the covering 12 to use the apparatus 10 as a slipper. In at least one embodiment, the covering 12 is a fabric which stretches and hugs around the foot 30 to keep the foot 30 warm when the foot 30 is fully inserted underneath the covering 12. Once the foot 30 is removed the stretchy fabric of the covering 12, in at least one embodiment, returns back to its flat position at the surface of the base or foot bed 14 of the flip-flop or apparatus 10. The dual function of the apparatus 10 or "Slip Flop" can be used alternatively as the ambient temperature changes. In at least one embodiment, any stretchy material, which has the quality to be elastic enough to stretch to two hundred percent of its original shape (i.e. double in size) and return to one hundred percent of its original shape (i.e. its original size) can be used for the covering 12. Polyester with more than eighteen percent of Spandex (trademarked) may be used for the covering 12. The foot bed surface or surface of base 14, in at least one embodiment, should be textured in such a manner as to keep the fabric or covering 12 from sliding, while walking. The base 14 or sole 14 may be made of fully molded foot bed ethylene-vinyl acetate (EVA) material for comfort. Possibly a "sandwich" construction with tougher outsole and softer insole material may be used for base 14. The covering 12 may have a fabric edge 12*a*, at the opening to slide foot 30 in. The fabric edge 12*a*, in at least one embodiment, is strong and elastic. The fabric edge 12*a* may be thin and comfortable to step on and walk, such as when a foot 30 is placed on top of the covering 30. The portion 20 may be a strap "pole" and may be finished as a "button hole" or with a delicate grommet. The portion 20 or strap "pole" can be decorative, such as a jewelry style.

The apparatus 10 of FIG. 1A can be applied to or in combination with the water proof or aqua embodiment of FIG. 5 or FIGS. 6A-6D, which will be described.

Figure 2A:
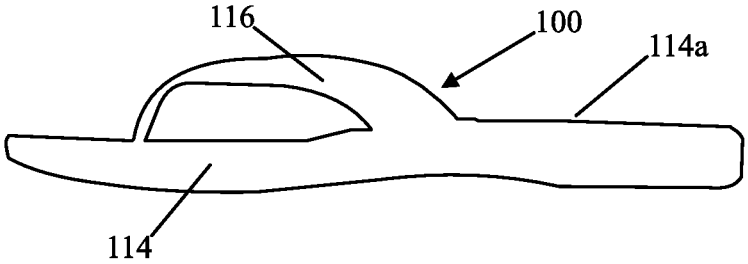
FIG. 2A shows a side view of an apparatus or flip-flop in accordance with another embodiment of the present invention.
Figure 2B:
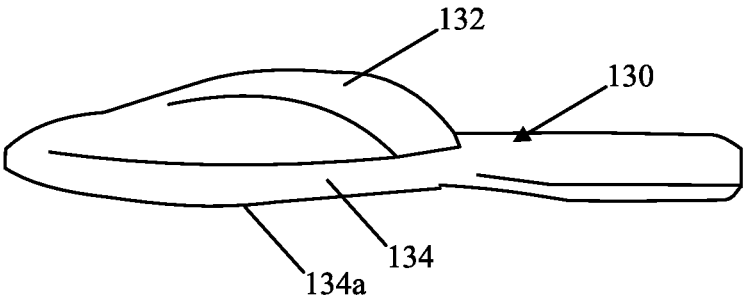
FIG. 2B shows a side view of an apparatus or slipper that can be inserted into the apparatus of FIG. 2A.

FIG. 2A shows a side view of an apparatus 100 with a base 114 and a strap 116. FIG. 2B shows a side view of an apparatus 130. The apparatus 130 can be inserted into the apparatus 100 in order to provide a slipper and flip-flop combination. The apparatus 130 includes a covering 132 similar to the covering 12 of FIG. 1A. The apparatus 100 includes a base 114 similar to the base 14 of FIG. 1A. In the FIGS. 2A-B embodiment, an apparatus identical to or similar to 130, except for color or some pictorial design aspect may be inserted into the apparatus 100 instead of apparatus 130. In this manner, the "Slip Flop" user can switch different designs and different colors.

In addition, the apparatus 130 may include a base 134 which may have a Velcro (trademarked) hooks or loops material on the bottom 134*a* of the base 134. The apparatus 100 may include a top 114*a* which may have a mating hooks or loop material, which mates with the material on the bottom 134*a* to hold the apparatus 130 on the apparatus 100.

The apparatus 130 or insert can be made of a variety of materials such as a sock-like softer material or a harder material like felt or sheepskin. This alternative can be applied in a full sandal where "Velcro" (trademarked) may not be required. Three basic shapes of the slipper insert, such as apparatus 130, may be possible in one or more embodiments: (a) one-third coverage by covering 132, which would cover toes only and end at the straps; (b) two-thirds coverage, like a typical slipper, and (c) full coverage, like a slipper with heel covered or any sandal type footwear.

There are an endless variety of color and design for the apparatus 130. The FIGS. 2A-B embodiment can be applied to or in combination with the water proof or aqua embodiment of FIG. 5 or FIGS. 6A-6D, which will be described.

Figure 3A:
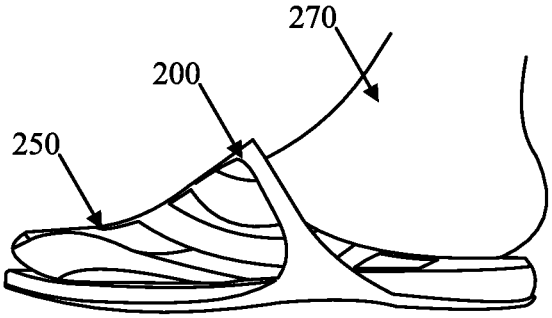
FIG. 3A shows a side view of a combination apparatus of flip-flop and slipper in accordance with another embodiment of the present invention with a foot inserted into the slipper and the slipper fully inserted into the flip-flop.
Figure 3B:
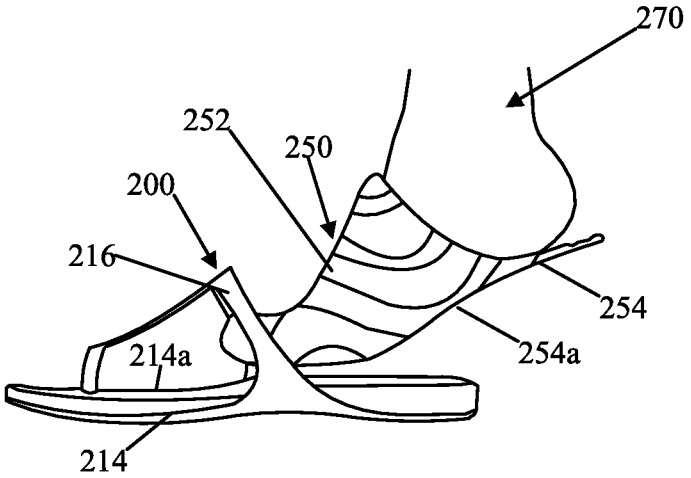
FIG. 3B shows a side view of the combination apparatus of FIG. 3A with the slipper only inserted partially into the flip-flop.
Figure 3C:
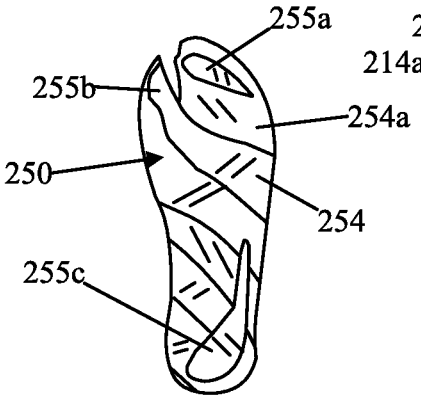
FIG. 3C shows a bottom view of the slipper apparatus of FIGS. 3A-3B.
Figure 3D:
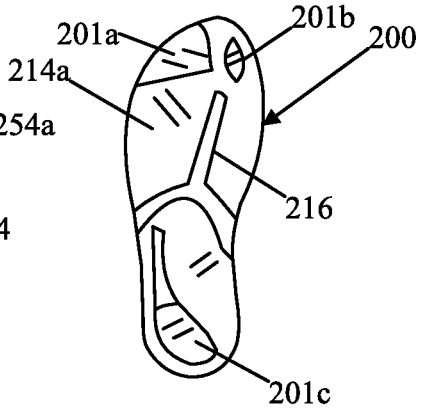
FIG. 3D shows a top view of the flip-flop apparatus of FIGS. 3A-3B.

FIG. 3A shows a side view of a foot 270, whose toes have been inserted into the an apparatus or slipper 250, which has been fully inserted into an apparatus or sandal 200. FIG. 3B shows a side view of the foot 270 and apparatus or slipper 250, which has been partially taken out of the sandal 200. FIG. 3C shows a bottom view of the apparatus or slipper 250. FIG. 3D shows a top view of the apparatus or sandal 200. The apparatus or slipper 250 may have a base 254 having a bottom surface 254*a* which may include a hooks and/or loops material. The hooks and loops material of 254*a* may connect and mate with a mating hooks and/or loops material of surface 214*a* to attach the apparatus 250 with the sandal 200.

The apparatus or sandal 200 may include Velcro (trademarked) (hook and/or loops) sections 201*a*, 201*b*, and 201*c*, shown in FIG. 3D. The apparatus or slipper 250 may include Velcro (trademarked) sections 255*a*, 255*b*, and 255*c*, which may mate with, align with, and may be the same shape (although though shown roughly in FIGS. 3C and 3D), as their mating sections 201*a*, 201*b*, and 201*c*, when the foot 270 with the apparatus 250 is placed in the apparatus 200 as shown in FIG. 3A.

The embodiment of FIGS. 3A-D may be applied to a sandal instead of a flip-flop and can be applied to any design of sandals, such as ladies' or men's.

Figure 4A:
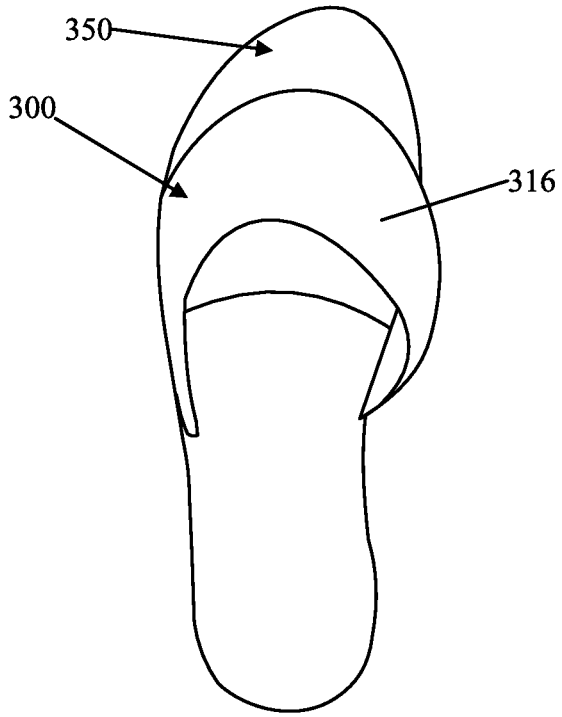
FIG. 4A shows a top view of another combination apparatus in accordance with the present invention, which may be a combination of flip-flop or sandal and slipper.
Figure 4B:
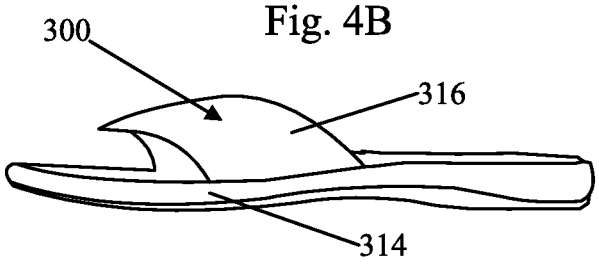
FIG. 4B shows a side view of the flip-flop or sandal apparatus or portion of the combination of FIG. 4A.
Figure 4C:
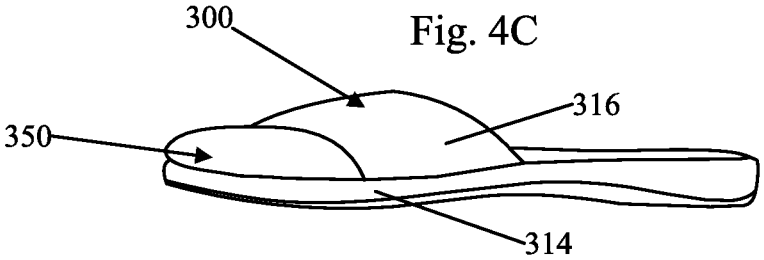
FIG. 4C shows a side view of the slipper apparatus or portion of the combination of FIG. 4A.

FIG. 4A shows a top view of an apparatus 300 in combination with an apparatus 350. FIG. 4B shows a side view of the apparatus 300 without the apparatus 350. FIG. 4C shows a side view of the apparatus 300 in combination with the apparatus 350. The combination of the apparatus 300 and 350, shown in FIG. 4A and 4C, may be a convertible sandal or sandal and slipper in one. The apparatus 300 may be a sandal and the apparatus 350 may be a slipper. The apparatus 300 may be or may be replaced by a sandal with a buckled strap or ankle strap, ladies' or mens'. The apparatus 300 may include a strap 316 and a base 314. The apparatus 300 may be made of materials as for flip-flops or sandals previously described in FIGS. 1A, 10, 1D, 2A, and 3B. The apparatus 350 may be made of materials as for slippers previously described for FIGS. 1B, 2B, and 3B.

Figure 5:
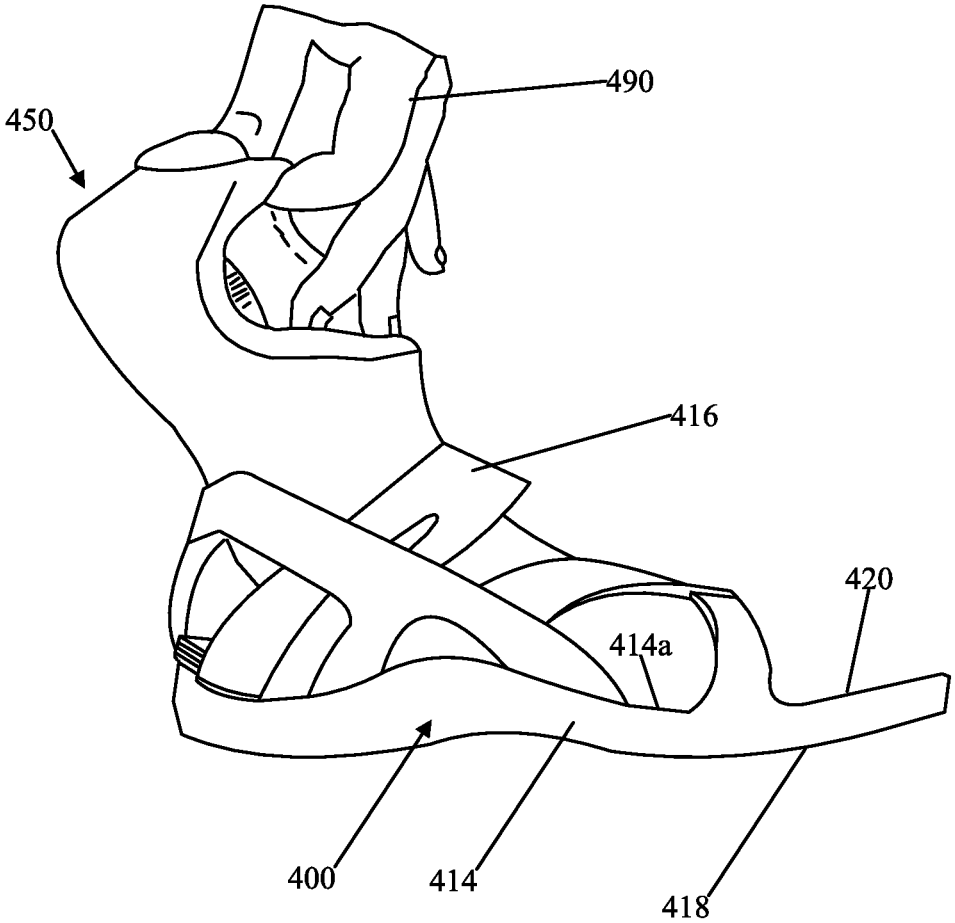
FIG. 5 shows a side view of a sandal and slipper combination apparatus in accordance with another embodiment of the present invention.

FIG. 5 shows a side view of an apparatus or sandal 400 and an apparatus or slipper 450, along with part of a person's hand 490. The combination of the apparatus 400 and the apparatus 450 in FIG. 5 may be called a convertible aqua sandal. The apparatus or slipper 450 may be made of a water proof stretchy aqua fabric. The apparatus or slipper 450 may be securely attached to the perimeter edge 414*a* of the apparatus 400 base or foot bed 414. The apparatus 400 may also include a plurality of straps 416.

The apparatus or slipper 450 can be attached to the apparatus or sandal 400 by fusion, sawing or sandwiching between the inner and outer sole of the foot bed or base 414. The base 414 may have an outer sole, portion or surface 418, and an inner sole, portion or surface 420. The outer sole, portion or surface 418 may be made of a hard material, while the inner sole 420 may be made of a soft material. The base 414 may include an inner material between the inner sole 420 and the outer sole 418, and the inner material of the base 414 may be made of EVA (ethylene-vinyl acetate) polymer or rubber foam.

An individual can use the combination of apparatus 400 and 450, also called a "Slip Flop", as a regular flip-flop, by simply placing the individual's foot in the apparatus 400 (under the straps 416, and on top of the base 414) and on top of the apparatus or aqua (water-proof) fabric 450. However, the stretchy aqua fabric or apparatus 450 on the foot bed or base 414 allows a person to slip their foot into the apparatus 450 or slipper and under the fabric to use it as an aqua shoe/slipper. The fabric of apparatus 450 stretches and hugs around an indivdual's foot to keep a foot warm in the cold weather. Once the foot is removed the stretchy fabric of the apparatus 450 returns back to its flat position at the surface or base 414 of the foot bed of the flip-flop or apparatus 400. The combination of the apparatus 400 and the apparatus 450 is a type of water footwear that will protect a person's foot from painful surfaces, keep the person's foot warm in cold water, and provide support for feet.

Figure 6A:
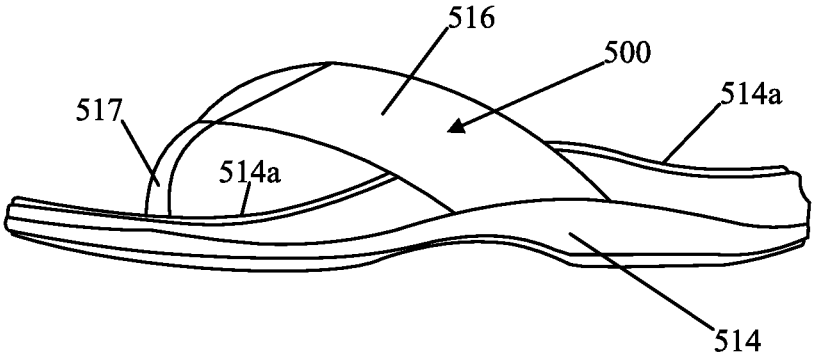
FIG. 6A shows a side view of a flip-flop or sandal apparatus in accordance with another embodiment of the present invention.
Figure 6B:
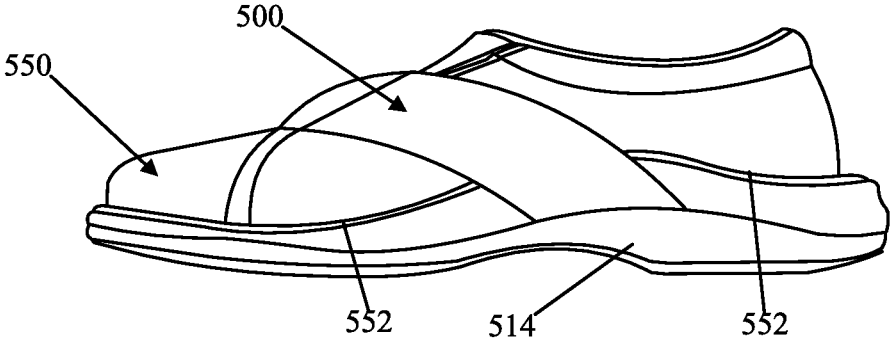
FIG. 6B shows a side view of a combination of flip-flop or sandal of FIG. 6A and a slipper.
Figure 6C:
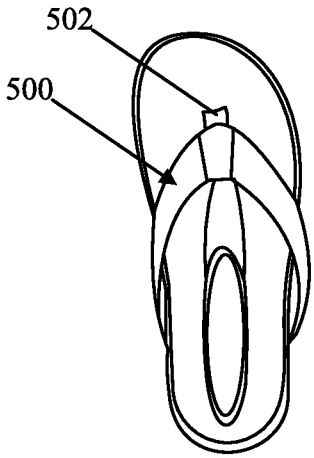
FIG. 6C shows a top view of the flip-flop or sandal apparatus of FIG. 6A.
Figure 6D:
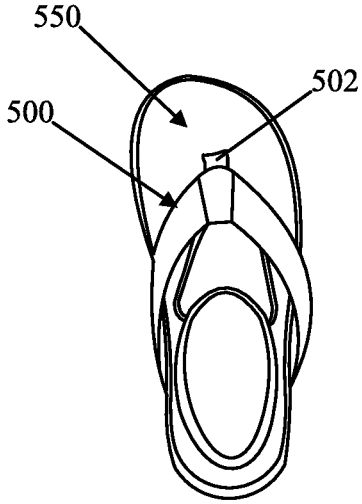
FIG. 6D shows a top view of the combination apparatus of FIG. 6B.

FIG. 6A shows a side view of an apparatus, flip-flop, or sandal 500. FIG. 6B shows a side view of an apparatus or slipper 550 in combination with the apparatus 500. FIG. 6C shows a top view of the apparatus 500. FIG. 6D shows a top view of the combination of apparatus 500 and apparatus 550. The apparatus 500 may include a strap 516 and a base 514. The apparatus 500 may have a top surface or portion 514*a* made of hooks and/or loops material, such as Velcro (trademarked). The apparatus 550 may have a bottom surface or portion 552 made of hooks and/or loops material, such as Velcro (trademarked) which mates and joins with the portion 514*a* to attach (and allow detachment) of the apparatus of slipper 550 to the apparatus 500. The apparatus or slipper 550 may be an aqua sock. The apparatus 500 may include eyelet fabric or grommet 502 shows in FIGS. 6C and 6D. The apparatus 500 includes thong band 517 shown in FIG. 6A.

The combination of apparatus 500 and apparatus 550 can be used as a regular flip-flop/slipper by placing the apparatus or sock 550 on the foot bed or base 514, which will attach through Velcro (trademarked), i.e. 514*a* attached to 552. In at least one embodiment, Velcro (trademarked) fabric hook-and-loop fasteners for 514*a* may include two lineal fabric strips and for 552 may include two mating lineal fabric strips configured to be aligned with the 514*a* strips when apparatus 550 is in the position shown in FIG. 6B with respect to the apparatus 500. The mating lineal fabric strips may include a first component of tiny hooks and a second component of smaller hair loops. When the two faces (i.e. 514*a* and 552) are pressed together, the hooks catch in the loops and 514*a* and 552 attach together. The aqua sock or apparatus 550 and the flip-flop or apparatus 500 can be separated, by pulling the two surfaces (552 and 514*a*) apart.

Figure 7A:
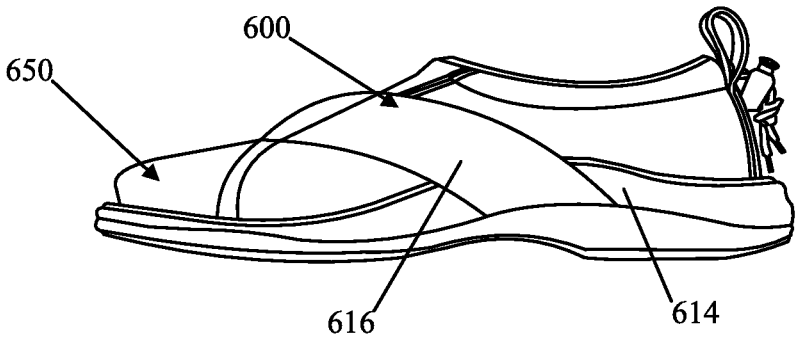
FIG. 7A shows a side view of a combination of flip-flop or sandal and a slipper in accordance with another embodiment of the present invention, with the slipper inserted fully into the flip-flop or sandal.
Figure 7B:
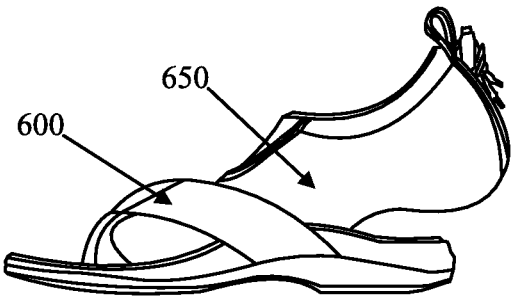
FIG. 7B shows a side view of the apparatus of FIG. 7A, with the slipper only partially inserted into the flip-flop or sandal.
Figure 7C:
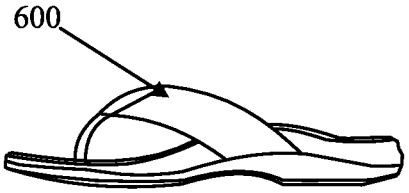
FIG. 7C shows a side view of the flip-flop or sandal of FIG. 7A.
Figure 7D:
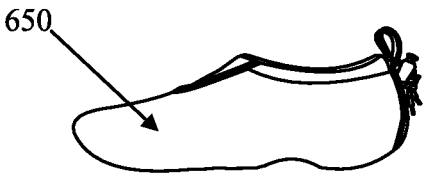
FIG. 7D shows a side view of the slipper of FIG. 7A.

FIG. 7A shows a side view of a combination of an apparatus 600 or sandal and an apparatus 650 or slipper, with the slipper or apparatus 650 fully inserted into the apparatus 600. FIG. 7B shows a side view of the combination of apparatus 600 and 650, with the apparatus 650 only partially inserted into the apparatus 600. FIG. 7C shows a side view of the apparatus 600. FIG. 7D shows a side view of the apparatus 650.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A shoe apparatus comprising: a base component comprising a sole having a forefoot portion and a perimeter edge including a forward edge, a left edge, a right edge and a rear edge; a strap component comprising a strap and a center connector, said strap having two ends, one end attached to the left edge and the other end attached to the right edge; and a cover component comprising a material having an aperture for receiving said center connector, said material positioned between the base component and the strap, and attached to the forward edge, left edge and right edge of said sole, thereby forming a first opening at the rear edge between said cover component and said sole; said center connector positioned through said aperture and connected to said forefoot portion of the sole, said strap component forming a second opening between said cover component and said strap, each opening having a size for receiving a person's foot.

2. The shoe apparatus of claim 1, wherein the material comprises a flexible fabric.

3. The shoe apparatus of claim 1, wherein the material comprises an elastic material.

4. The shoe apparatus of claim 3, wherein the elastic material is configured in a manner such that the cover component lies flat on the sole in a contracted state when the person's foot is received in the second opening, and the cover component is stretched out in an expanded state when the person's foot is received in the first opening.

5. The shoe apparatus of claim 1, wherein the material comprises polyester.

6. The shoe apparatus of claim 1, wherein the material comprises polyester with more than eighteen percent of spandex.

7. The shoe apparatus of claim 1, wherein the aperture for receiving the center connector comprises a button hole.

8. The shoe apparatus of claim 1, wherein the aperture for receiving the center connector comprises a grommet.

9. The shoe apparatus of claim 1, wherein the base component comprises a water proof material.

10. The shoe apparatus of claim 1, wherein the base component comprises ethylene-vinyl acetate.

* * * * *